US009050600B2

(12) United States Patent
Ha

(10) Patent No.: US 9,050,600 B2
(45) Date of Patent: Jun. 9, 2015

(54) CONE-SHAPED CRUSHER

(75) Inventor: Yong-Gan Ha, Chungbuk (KR)

(73) Assignee: Yong-Gan HA, Goesan-Gun, ChungCheongbuk-do ( * ) Notice: Subject to any disclaimer, the term of this patent is extended or adjusted under 35 U.S.C. 154(b) by 92 days.

(21) Appl. No.: 14/009,109

(22) PCT Filed: Apr. 16, 2012

(86) PCT No.: PCT/KR2012/002880

§ 371 (c)(1),
(2), (4) Date: Oct. 1, 2013

(87) PCT Pub. No.: WO2012/141559

PCT Pub. Date: Oct. 18, 2012

(65) Prior Publication Data

US 2014/0224909 A1 Aug. 14, 2014

(30) Foreign Application Priority Data

Apr. 14, 2011 (KR) ..... 10-2011-0034523

(51) Int. Cl.

| | |
|---|---|
| ***B02C 2/04*** | (2006.01) |
| ***B02C 2/06*** | (2006.01) |
| ***B02C 2/02*** | (2006.01) |
| *B02C 2/00* | (2006.01) |

(52) U.S. Cl.

CPC ... *B02C 2/06* (2013.01); *B02C 2/02* (2013.01); *B02C 2/00* (2013.01); *B02C 2/04* (2013.01)

(58) Field of Classification Search

CPC ..... B02C 2/00; B02C 2/02; B02C 2/04
USPC ..... 241/208, 214
See application file for complete search history.

(56) References Cited

U.S. PATENT DOCUMENTS 5,938,133 A * 8/1999 Bayliss et al. ..... 241/214
6,000,648 A * 12/1999 Ambrose ..... 241/215
6,036,129 A * 3/2000 Ambrose ..... 241/207

(Continued)

FOREIGN PATENT DOCUMENTS

JP 08-266918 A 10/1996
JP 10-504234 A 4/1998

(Continued)

OTHER PUBLICATIONS

International Search Report in International Application No. PCT/KR2012/002880, dated Sep. 5, 2012.

*Primary Examiner* — Faye Francis
(74) *Attorney, Agent, or Firm* — Lowe Hauptman & Ham, LLP

(57) ABSTRACT

The invention relates to a cone-shaped crusher including a frame having a cavity, a main shaft disposed eccentrically in the frame, and an eccentric drive making the main shaft perform a gyratory movement. The eccentric drive includes an upper eccentric shaft, a lower eccentric shaft, and an eccentric bearing. The upper eccentric shaft has an opening provided at its central portion to allow the lower end portion of the main shaft to pass through the opening, and an upper coupling part provided at its lower portion and fastened to the lower eccentric shaft. The lower eccentric shaft has a lower coupling part fastened to the upper eccentric shaft. The eccentric bearing accommodates the lower end portion of the main shaft and is disposed in a space defined by the upper eccentric shaft and the lower eccentric shaft.

15 Claims, 4 Drawing Sheets

(56) References Cited

U.S. PATENT DOCUMENTS

| | | | | |
|---|---|---|---|---|
| 6,877,682 | B2 * | 4/2005 | Nieminen et al. | 241/36 |
| 8,944,356 | B2 * | 2/2015 | Kuvaja | 241/207 |
| 2010/0155518 | A1 * | 6/2010 | Eriksson et al. | 241/214 |
| 2014/0021280 | A1 * | 1/2014 | Anttila et al. | 241/214 |

FOREIGN PATENT DOCUMENTS

| | | | |
|---|---|---|---|
| JP | 2001-162186 | A | 6/2001 |
| KR | 20-0433276 | Y1 | 12/2006 |
| KR | 10-0809900 | B1 | 3/2008 |
| WO | 2009-065995 | A1 | 5/2009 |

* cited by examiner

CONE-SHAPED CRUSHER

CROSS-REFERENCE TO RELATED APPLICATIONS

This application is the National Stage filing under 35 U.S.C. 371 of International Application No. PCT/KR2012/002880, filed on Apr. 16, 2012, which claims the benefit of Korean Patent Application No. 10-2011-0034523, filed on Apr. 14, 2011, the contents of which are all hereby incorporated by reference herein in their entirety.

TECHNICAL FIELD

The present invention relates to a cone-shaped crusher, and more particularly, to a cone-shaped crusher including an eccentric driving means that makes the main shaft undergo a gyratory movement.

BACKGROUND ART

This application claims the benefit of Korean Patent Application No. 10-2011-0034523 filed on Apr. 14, 2011. All of the contents disclosed in the description and drawings of this application are incorporated herein by reference.

Cone-shaped crushers are very important crushers in aggregate and mineral processing industries. Various structures and types have been developed for a variety of uses.

Korean Patent Registration No. 10-0809900 discloses a cone-shaped crusher including an eccentric drive that makes the main shaft undergo a gyratory movement. The cone-shaped crusher includes a frame with a cavity, a main shaft disposed in the frame, and an eccentric driving means connected to a lower end portion of the main shaft. The lower end portion of the main shaft is inserted into an opening formed in an upper portion of the eccentric driving means. Three bearings including an upper bearing, a central bearing, and a lower bearing are provided in the vicinity of the lower end portion of the main shaft, and the main shaft is fitted into the central bearing among the bearings. On the upper portion of the eccentric drive is formed an opening and the diameter of it is larger than that of the outer diameter of the central bearing in order to put the central bearing into the eccentric drive. The upper bearing is fitted on the upper end of the eccentric drive after forming a separate mount so as to be eccentric from the opening. Therefore, the internal diameter of the upper bearing is larger than the outer diameter of the central bearing, and the size of the upper bearing becomes inevitably very large.

Generally, the cone-shaped crusher is a large-size machine, and a bearing to be used as the upper bearing should be much larger than the size of a widely used standard bearing and is not readily available in the market. Therefore, the bearing should be made to order. However, as the size of the bearing gets larger, there is a problem in that the costs increase rapidly, therefore, the costs for replacing the upper bearing are huge. In addition to such high cost, with the bearing size increasing, rated rotating velocity is gradually slowed which limits the operation velocity of the cone-shaped crusher. This means that the capacity of the crusher is limited and low efficiency crushers are obliged to be made due to big upper bearings

DETAILED DESCRIPTION OF THE INVENTION

Technical Objectives

The invention has been made in order to solve the above-described problem and to provide a cone-shaped crusher that can use a small-sized bearing as an upper bearing of the eccentric drive.

Another objective of the invention is to provide a cone-shaped crusher that can reduce manufacturing costs and maintenance expenses.

In addition, another objective of the invention is to provide a cone-shaped crusher that has increased crushing capacity by improving the movement speed of the main shaft.

Means for Solving the Problems

In order to achieve the above objectives, a cone-shaped crusher according to a preferred embodiment of the invention includes a frame having a cavity; a main shaft disposed in the cavity eccentrically from the central axis of the frame; and an eccentric drive coupled to a lower end portion of the main shaft so as to make the main shaft undergo a gyratory movement. The eccentric drive includes an upper eccentric shaft, a lower eccentric shaft, and an eccentric bearing. The upper eccentric shaft has an opening provided at the central portion thereof to allow the lower end portion of the main shaft to pass through the opening. The opening is eccentric to the rotation center of the upper and lower eccentric shaft and concentric to central bearing. On the upper eccentric shaft, an upper coupling part is provided at its lower portion and it is combined to the lower eccentric shaft. The lower eccentric shaft has a lower coupling part at its upper portion and it is fastened to the upper eccentric shaft. The eccentric central bearing accommodates the lower end portion of the main shaft and is disposed in a space defined by the upper eccentric shaft and the lower eccentric shaft.

Preferably, the upper eccentric shaft has a small-diameter portion on its upper end to be the upper bearing mount.

Preferably, the lower eccentric shaft has an eccentric bearing mount formed inside of the upper end portion of the lower eccentric shaft, the eccentric bearing being provided on the eccentric bearing mount; and a small-diameter bearing mount on its lower portion to be a lower bearing mount.

Preferably, a counterweight is provided at the upper eccentric shaft or the lower eccentric shaft so as to offset the vibration generated by the gyratory movement of the main shaft and mantle core assembly.

Preferably, in order to prevent slippage between the main shaft and the inner ring of the eccentric bearing, a key groove is formed on the lower end portion of the main shaft accommodated inside the eccentric bearing and on the inner surface of the inner ring of the eccentric bearing, and a key is inserted into the key grooves.

Preferably, the opening formed in the upper eccentric shaft is processed in a tapered shape such that the inner diameter of the opening gradually decreases downward from an uppermost end of the opening to a predetermined depth.

Preferably, the cone-shaped crusher further includes a plurality of lubricating oil jetting holes located above the upper eccentric shaft. The discharging angle of the lubricating oil jetting holes is set such that some of the lubricating oil jetting holes supply the lubricating oil toward the main shaft and other lubricating oil jetting holes supply the lubricating oil toward an upper bearing fitted on an upper end portion of the upper eccentric shaft.

Preferably, the eccentric bearing mount has a diameter such that the eccentric bearing is mountable on the eccentric bearing mount, and the diameter is greater than the minimum diameter of the opening of the upper eccentric shaft.

Preferably, the lower eccentric shaft further includes a lubricating oil outlet that connects the eccentric bearing chamber to the outside of the lower eccentric shaft.

Preferably, an outer circumferential surface of an upper end portion of the lower eccentric shaft and an inner circumferential surface of a lower end portion of the upper eccentric shaft are tapered such that the diameter gradually decreases upward from below. The lower eccentric shaft and the upper eccentric shaft are fastened to each other in a way where the lower eccentric shaft is fitted on the upper eccentric shaft such that the outer circumferential surface of the upper end portion of the lower eccentric shaft abuts against the inner circumferential surface of the lower end portion of the upper eccentric shaft.

Preferably, the eccentric drive further includes an eccentric shaft coupling nut. The upper eccentric shaft comprises a male thread formed in an outer circumferential surface of the lower end portion of the upper eccentric shaft. A stair part is formed on a lower periphery of the lower coupling part of the lower eccentric shaft. The eccentric shaft coupling nut has a flange capable of pressing the stair part of the lower eccentric shaft, and a female thread coupled to the male thread is formed on an inner circumferential surface of a pipe extending upward from the flange.

Preferably, the eccentric drive is driven by a first bevel gear attached to the upper eccentric shaft or the lower eccentric shaft and a second bevel gear meshing with the first bevel gear.

Preferably, the eccentricity drive is driven by a pulley directly fitted to a lower end portion of the lower eccentric shaft.

Preferably, the cone-shaped crusher further includes v-belt protective lids provided parallel to two sides formed by exposed v-belts to protect the belts connecting the pulleys.

Preferably, the cone-shaped crusher further includes an eccentric drive outer wall surrounding the outside of the upper eccentric shaft and the lower eccentric shaft, the eccentric drive outer wall is fixed to the frame with a plurality of link legs, and at least two of the link legs are parallel to the two sides formed by the v-belts.

Advantages of the Invention

The cone-shaped crusher according to the invention has the following advantages.

Firstly, it is possible to provide a cone-shaped crusher that includes a small-sized bearing fitted on the upper end of the eccentric drive that makes the main shaft perform a gyratory movement.

Secondly, it is possible to provide a cone-shaped crusher that can reduce manufacturing costs and maintenance expenses.

Thirdly, it is possible to provide a cone-shaped crusher that can increase the crushing capacity by improving the gyratory movement speed of the main shaft.

BEST MODES FOR CARRYING OUT THE INVENTION

Figure 1:
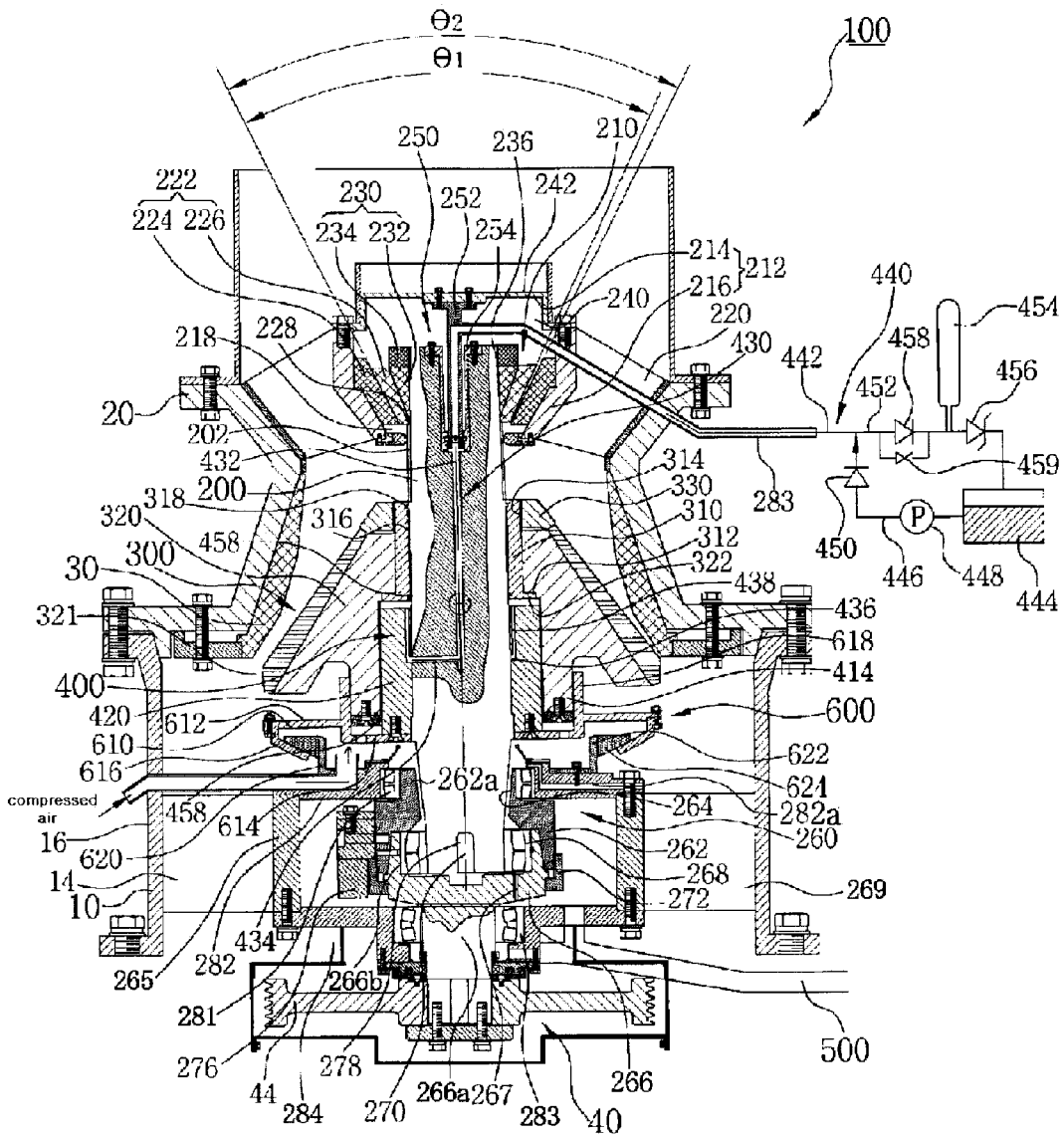
FIG. 1 is a sectional view schematically illustrating a cone-shaped crusher according to an embodiment of the invention.

A gyratory crusher and the like as well as a typical cone crusher are commonly referred to as a cone-shaped crusher in the following description.

Hereinafter, a cone-shaped crusher according to a preferred embodiment of the invention will be described in detail with reference to the accompanying drawings.

The terms and words used in the description and claims of the application should not be limited or interpreted as common or dictionary meanings, but should be interpreted as meanings and notions that conform with the technical ideas of the invention, on the basis of the principal in which the notions of the terms can be appropriately defined in order for the inventor to describe his invention in the best way. Thus, since the embodiments described in the present description and the configurations illustrated in the drawings are merely most preferable embodiments of the invention, and do not represent all the technical ideas of the invention. It should be understood that the invention covers various equivalents and modifications that can replace these embodiments' configurations when the present application is filed.

For convenience and clarity of the description in the drawings, the sizes of respective constituent elements or specific parts of the constituent elements are exaggerated, omitted, or schematically illustrated. Therefore, the sizes of the respective constituent elements do not reflect actual sizes completely. If it seems to be that the specific descriptions regarding the relevant publicly well known functions or configurations make the key point of the invention unnecessarily ambiguous, such descriptions will be omitted.

FIG. 1 is a sectional view schematically illustrating a cone-shaped crusher according to an embodiment of the invention.

Referring to FIG. 1, a cone-shaped crusher 100 according to the invention includes a main frame 10 having a cavity formed therein; an upper frame 20 seated on an upper portion of the main frame 10, having a cavity formed therein, and having at least one or more layers; a concave 30 formed in a truncated funnel shape having an inner diameter that gradually increases downward from above, and fitted to a lower inner circumferential surface of the upper frame 20; a main shaft 200 having a lower end accommodated in the main frame 10 and an upper end arranged to pass through the concave 30 and accommodated in the upper frame 20 to perform a gyratory movement; a mantle core assembly 300 disposed so as to be slideable up and down along the longitudinal direction of the main shaft 200; a piston 420 provided at a central portion of the main shaft 20 and allowing a hydraulic force to be exerted on the mantle core assembly 300; a crushing gap adjustment means 400 moving the mantle core assembly 300 toward the concave 30 so as to adjust the crushing gap; an eccentric drive 260 making the main shaft 200 perform a gyratory movement; and driving means for the eccentric drive 40 rotating the eccentric drive 260 to move the main shaft 200 such that the main shaft undergoes a gyratory movement.

The mantle core assembly 300 disposed apart from a lower portion of the concave 30 includes a cylindrical upper sleeve 310 slideably fitted on the main shaft 200 and a mantle core 320 formed in a truncated cone shape having a diameter that gradually increases downward from above and accommodating the upper sleeve 310, and a mantle 321 mounted on an outer circumferential surface of the mantle core 320.

A cylindrical cavity having a relatively larger diameter is formed in a central lower portion of the mantle core assembly 300, and a cylindrical cavity having a relatively smaller diameter is continuously provided in a stair shape in a central upper portion of the mantle core assembly 300.

A portion of an upper end of the upper sleeve 310 is exposed above the mantle core 320, a thread 314 is formed in an outer circumferential surface of the exposed end of the upper sleeve 310, and a fixing nut 330 is fastened to the thread 314 in order to mount the mantle 321 on the mantle core 320. A flange 312 is formed at a lower end portion of the upper sleeve 310, and a recessed portion 322 having a shape corresponding to the shape of the flange 312 is formed in the inner circumferential surface of the mantle core 320 such that the flange 312 is inserted there into. The flange 312 is provided so as to prevent the upper sleeve 310 from being pulled out upward even if the fixing nut 330 is strongly tightened so as to affix the mantle 321 onto the mantle core 320. Unlike those shown in FIG. 1, the sleeve 310 may be designed in a taper shape that has a broader lower portion with no flange 312.

In order to prevent the main shaft 200 from being worn out, the surface of the main shaft 200 on which the upper sleeve 310 slides may be subjected to high-frequency heat treatment, or a protective sleeve 202 subjected to heat treatment may be fitted on a portion of the main shaft 200 so as not to interfere with the upper sleeve 310. FIG. 1 illustrates a state where the protective sleeve 202 is mounted. More preferably, a liner 316 made of a material, such as brass or lead bronze, may be used so as to be fitted on an inner circumferential surface of the upper sleeve 310, or soldering with brass or the like may be performed on the inner circumferential surface, or a high-molecular lubricious material may be coated on the inner circumferential surface. Moreover, in order to prevent dust from flowing in along an outer circumferential surface of the main shaft 200, an annular dust seal 318 may be mounted on the upper portion of upper sleeve 310. Grease may be intermittently injected into a gap between the main shaft 200 and the liner 316 located below the dust seal 318 through a grease nipple (not shown), and a spiral groove for holding the grease is formed in the inner surface of the liner 316. A sleeve made of a material, such as brass, lead bronze, or a high-molecular lubricious material, is also fitted on a lower inner wall where the mantle core 320 is coupled to the piston 420, or the inner wall is coated or soldered with lubricious material, and a seal, such as an O-ring, for preventing hydraulic oil from leaking is attached to the inner wall.

The mantle core assembly 300 formed in this way slides along the main shaft 200 by the hydraulic oil flowing in through the main shaft 200 from the outside source.

Figure 2:
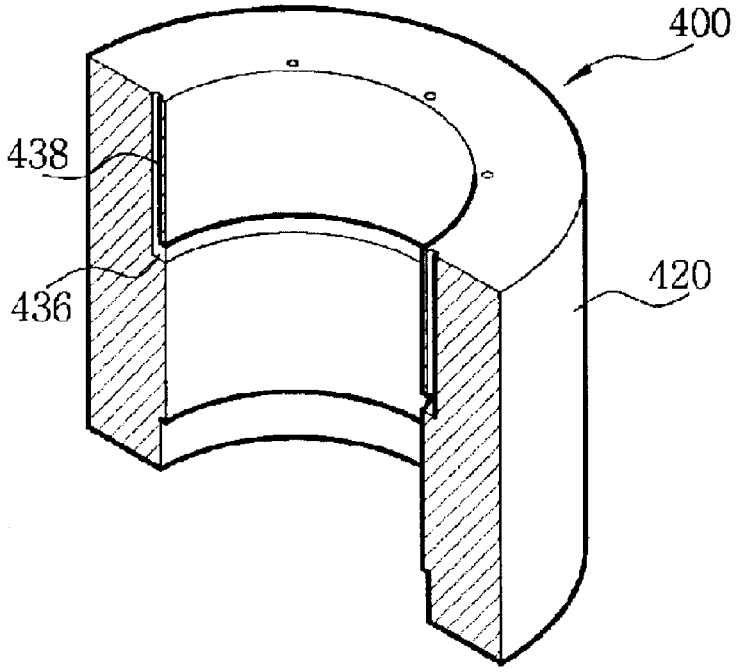
FIG. 2 is a partially cutaway perspective view illustrating a piston used for the cone-shaped crusher shown in FIG. 1.

FIG. 2 is a partially cutaway perspective view illustrating the piston used for the cone-shaped crusher shown in FIG. 1.

Crushing gap adjustment method and mechanism of the invention will be described with reference to FIGS. 1 and 2. Compared to a general hydraulic cylinder mechanism, the mantle core 320 functions as a cylinder, and the piston 420 tightly fastened to the main shaft 200 functions as a piston. However, in the invention, the piston 420 and the main shaft 200 only perform a gyratory movement without moving in a vertical direction, and on the contrary, the mantle core assembly 300 corresponding to the cylinder moves up and down to change a crushing gap.

First, to describe the flow of hydraulic oil, the hydraulic oil flowing out of or flowing into the system from an outer circuit is introduced through a conduit into a vertical pipe 252 of a rotary joint 250 tightly attached to a lid 214 of a suspension bearing chamber 212. The rotary joint 250 is a device smoothly connecting the main shaft 200, which performs a gyratory movement, and simultaneously, performs a low-speed rotational movement, to a fixed hydraulic oil conduit extending from the outside. The rotary joint 250 includes a rotary joint housing 254 and a vertical pipe 252.

A flange part is provided at an upper end portion of the rotary joint housing 254 for strong coupling with the main shaft 200, the flange part is coupled to the upper end portion of the main shaft 200 with bolts, and leakage of the hydraulic oil is prevented by an O-ring fitted into an O-ring groove formed at a lower end portion of the rotary joint housing. A seal is fitted into an annular groove formed in an inner surface directly above the lower end portion of the rotary joint housing 254, and the vertical pipe 252 extends to the groove and is coupled to the seal so as to prevent leakage of the hydraulic oil. From a geometric viewpoint, a position where the seal is disposed corresponds to the center of the gyratory movement of the main shaft 200, and corresponds to a position where the relative movement between the fixed vertical pipe 252 and the main shaft 200 performing a gyratory movement is the smallest, and thus, deformation of the seal depending on the gyratory movement of the main shaft 200 is the smallest at this position. The rotary joint may have various structures besides the above-described embodiment.

The hydraulic oil flows down to a central portion of the piston 420 along a first oil passage 432 formed at the central portion of the main shaft 200 through the rotary joint 250, and then passes through a second oil passage 434 formed horizontally and an annular third oil passage 436 formed in an inner circumferential surface of the piston 420. The annular third oil passage 436 is connected to a plurality of fourth oil passages 438 extending to the upper end of the piston 420, and finally, the hydraulic oil is injected to the upper end portion of the piston through the fourth oil passages 438. A force that pushes the piston 420 downward and a force that pushes the mantle core assembly 300 upward are simultaneously generated by the hydraulic oil injected in this way. In this case, the main shaft 200 and the piston 420 do not move downward by the support of the suspension bearing 222 coupled to the upper end of the main shaft, but by the mantle core assembly 300 moving upward. On the other hand, the crushing gap adjustment means 400 further includes a pressurized hydraulic oil supply part 440 disposed outside the cone-shaped crusher 100 according to the invention.

The pressurized hydraulic oil supply part 440 includes a connection pipe 442 connected to the first oil passage 432, a hydraulic tank 444 storing the hydraulic oil, and a hydraulic oil supply pipe 446 connecting the hydraulic tank 444 to the connection pipe 442. A hydraulic pump 448 is disposed in the hydraulic oil supply pipe 446 adjacent to the hydraulic tank 444, and a check valve 458 for preventing the hydraulic oil from flowing back to the hydraulic oil pump 448 is mounted on the hydraulic oil supply pipe 446 adjacent to the connection pipe 442. Moreover, a hydraulic pressure discharge pipe 452 connecting the hydraulic tank 444 to the connection pipe 442 is further included in the pressurized hydraulic oil supply part 440 separately from the hydraulic pressure supply pipe 446 so that the cone-shaped crusher 100 can be protected when an uncrushable object such as a lump of metal is put into a gap between the concave 30 and the mantle 321. A general hydraulic accumulator 454 is disposed in the hydraulic pressure discharge pipe 452, a check valve 585 and a bypass valve 459 are disposed in front of the hydraulic accumulator 454, and a relief valve 456 is disposed between the hydraulic accumulator 454 and the hydraulic tank 444.

If a lump of metal, which is not large, is put into the gap between the concave 30 and the mantle 321, the mantle core assembly 300 descends, and the hydraulic oil flowing out of the con-shaped crusher enters the hydraulic accumulator 454 through the check valve 458 and is temporarily stored. Also, if the uncrushable object is discharged from the crusher, the high-pressure hydraulic oil stored in the hydraulic accumulator 454 slowly flows again into the cone-shaped crusher through the bypass valve 459, and thus, the crushing gap of the cone-shaped crusher is recovered to the level formed before the foreign matter is put into the crusher.

However, if a large uncrushable object is put into the gap between the concave 30 and the mantle 321, the distance by which the mantle core assembly 300 should descend until the object is discharged is long, and thus, all the hydraulic oil coming out from the crusher cannot not be stored in the accumulator 454. Therefore, in this case, in order to prevent the pressure within the accumulator 454 from rising to a dangerous level, the hydraulic oil flows into the hydraulic tank 444 through the relief valve 456. However, if the large foreign matter is put into and then discharged from the crusher, the increased crushing gap of the crusher needs to be adjusted again by manually operating the hydraulic pump 448.

Referring back to FIG. 1, a suspension bearing part 210 supporting the main shaft 200 is disposed at an upper portion of the main shaft 200, and the eccentric drive 260 that makes the main shaft 200 perform a gyratory movement is disposed at a lower portion of the main shaft 200. The suspension bearing part 210 is disposed inside the upper frame 20, and the eccentric drive 260 is disposed inside the main frame 10.

Figure 3:
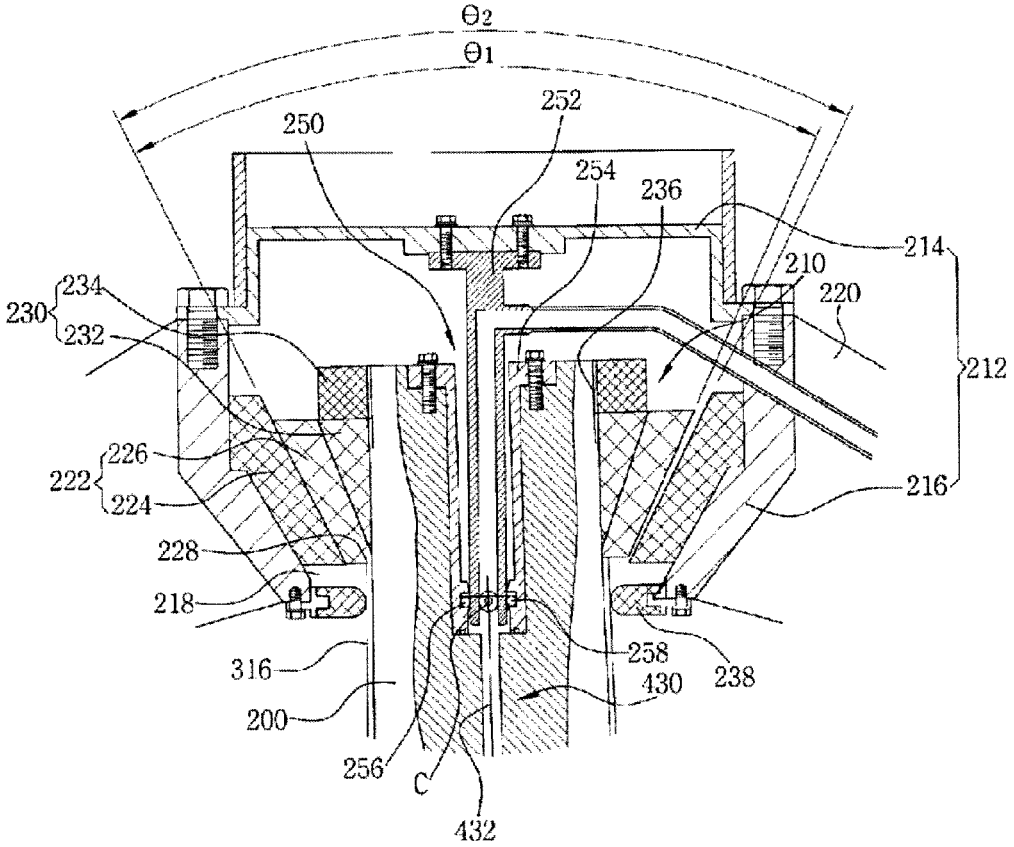
FIG. 3 is a partially enlarged view illustrating an upper end of a main shaft used for the cone-shaped crusher shown in FIG. 1.

FIG. 3 is a partially enlarged view illustrating the upper end of the main shaft used for the cone-shaped crusher shown in FIG. 1.

Referring to FIG. 3, the suspension bearing part 210 includes a suspension bearing chamber 212 into which the upper portion of the main shaft 200 is inserted, a suspension bearing 222 disposed inside the suspension bearing chamber 212 to support the upper portion of the main shaft 200 inserted into the suspension bearing chamber 212, and a fixing member 230 fixing the suspension bearing 222 to the main shaft 200.

The suspension bearing chamber 212 includes a suspension bearing chamber outer case 216 connected to an upper portion of the upper frame by supporting arms 220, and a detachable lid 214. The suspension bearing chamber outer case 216 includes an upper portion having a vertical cylindrical shape, and a lower portion having a truncated funnel shape. Also, a small step is formed between the vertical part and the inclined part, inside the suspension bearing chamber outer case 216.

The suspension bearing 222 includes a stationary ring 224 of which an outer circumferential surface comes into close contact with an inner circumferential surface of the suspension bearing chamber outer case 216, and a rotatable ring 226 fitted on the main shaft 200 inserted into the suspension bearing chamber 212 and disposed on the inner circumferential surface of the stationary ring 224 to perform a gyratory movement along the inner circumferential surface of the stationary ring 224. The stationary ring 224 and the rotatable ring 226 are formed in a truncated funnel shape having a diameter that gradually decreases downward from above. An annular stepped part 228 is formed at the main shaft 200, and the lower portion of the rotatable ring 226 is put on the stepped part 228. Also, an angle $\theta_1$ formed by an outer circumferential surface of the rotatable ring 226 is smaller than an angle $\theta_2$ formed by the inner circumferential surface of the stationary ring 224. A difference angle $\theta_2-\theta_1$ between the two angles is two times greater than the eccentric angle of the main shaft 200. Here, the eccentric angle is an angle between the centerline of the main shaft 200 and the centerline of a crusher frame. From a geometric viewpoint, the rotatable ring 226 always comes into linear contact with the inner circumferential surface of the stationary ring 224.

On the other hand, the fixing member 230 includes a detachable sleeve 232 fitted on the main shaft 200 such that the outer circumferential surface of the detachable sleeve 232 comes into close contact with the inner circumferential surface of the rotatable ring 226, and a fixing nut 234 fastened to an outer circumferential surface of the upper end of the main shaft 200. The outer circumferential surface of the upper end of the main shaft 200 is exposed above the detachable sleeve 232, and is formed with a male thread. In previously designed cone-shaped crushers, it is inevitable to loosely assemble an upper bearing and a main shaft to permit the main shaft move up and down through the upper bearing, and thus, wear of the bearing or the shaft occurs. However, in the invention, the fixing member 230 tightly fixes the rotatable ring 226 to the main shaft 200, and thus, wear of the shaft hardly occurs. The angle of the outer circumferential surface of the rotatable ring 226 and the angle of the inner circumferential surface of the stationary ring 224 may be arbitrarily adjusted depending on the angle of the mantle 321. The stationary ring 224 is preferably formed of a lubricious material, or the inner circumferential surface of the stationary ring 224 is preferably coated with a lubricious material, and the rotatable ring 226 is preferably formed of a hard material subjected to heat treatment. In order to reduce the wear between the rotatable ring 226 and the stationary ring 224, lubricant such as grease, is injected into the suspension bearing chamber 212, and the seal 238 is formed of an elastic material, such as rubber, to prevent the lubricant inside the suspension bearing chamber 212 from leaking.

Referring back to FIG. 1, the eccentric drive 260 that makes the main shaft 200 perform a gyratory movement includes an eccentric drive outer wall 265 fixed to a central lower portion of the main frame 10 with link legs 269, an upper eccentric shaft 262, a lower eccentric shaft 266, an eccentric bearing 268, and an eccentric shaft coupling nut 272. The upper eccentric shaft 262 and the lower eccentric shaft 266 are combined together by the eccentric shaft coupling nut 272. Preferably, in order to offset the vibration generated by the gyratory movement of the mantle core assembly 300 and the vibration generated by the gyratory movement of the main shaft 200, a counterweight 276 is provided at the upper eccentric shaft 262 or the lower eccentric shaft 266. In more detail, the counterweight 276 is provided opposite to a direction in which the lower end portion of the main shaft 200 is eccentric.

An upper bearing housing 282 and a lower bearing housing 284 are tightly coupled to the upper and lower portions of an eccentric drive outer wall 285. Also, the upper eccentric shaft 262 and the lower eccentric shaft 266 are surrounded by the upper and lower bearing housings 282 and 284, and the eccentric drive outer wall 265. Here, an upper bearing 281 is interposed between the upper bearing housing 282 and the upper eccentric shaft 262, and a lower bearing 283 is interposed between the lower bearing housing 284 and the lower eccentric shaft 26 so that the upper eccentric shaft 262 and the lower eccentric shaft 266 can be smoothly operated.

The upper eccentric shaft 262 has an opening at its central portion. The opening is eccentric from the rotation center of the upper eccentric shaft 262 itself and allows the lower end portion of the main shaft 200 to pass through there. Also, the upper eccentric shaft 262 has an upper coupling part coupled to the lower eccentric shaft 266 at the lower portion. Here, the opening is processed in a taper shape having an inner diameter that gradually decreases downward from the uppermost end to a predetermined depth. Also, the upper eccentric shaft 262 has a small diameter portion 262*a* at the upper end portion. The upper bearing 281 is mounted to the upper end of the small diameter portion 262*a*.

The lower eccentric shaft 266 includes a lower coupling part located below the upper eccentric shaft 262 and fastened to the upper eccentric shaft 262. Also, an eccentric bearing mount 266*b* in which the eccentric bearing 268 is mounted is formed inside an upper end portion of the lower eccentric shaft 266. A small diameter portion 266*a* to which the lower bearing 283 is mounted is formed at a lower end portion of the lower eccentric shaft 266. Here, the eccentric bearing mount 266*b* has such diameter that the eccentric bearing 268 can be mounted thereon, and this diameter is greater than the minimum diameter of an opening of the upper eccentric shaft 262. Moreover, the lower eccentric shaft 266 includes a lubricating oil outlet 267 connecting the eccentric bearing mount 266*b* and the outside of the lower eccentric shaft 266.

The eccentric bearing 268 accommodates the lower end portion of the main shaft 200, and is disposed in a space defined by the upper eccentric shaft 262 and the lower eccentric shaft 266 in a state where the eccentric bearing 268 is fixed to the eccentric bearing mount 266*b*.

An inner circumferential surface of a lower end portion of the upper eccentric shaft 262 is processed in a taper shape having a diameter that gradually decreases upward from below, and a male thread is formed on an outer circumferential surface of the upper eccentric shaft 262. Also, an outer circumferential surface of an upper end portion of the lower eccentric shaft 266 is processed in a taper shape having a diameter that gradually decreases upward from below, and a stair part is provided at the lower periphery of the tapered lower coupling part. On the other hand, the eccentric shaft coupling nut 272 includes a flange capable of pressing the stair part of the lower eccentric shaft 266, and a female thread coupled to the male thread formed on the upper eccentric shaft 262 is formed on an inner circumferential surface of a pipe part extending upward from the flange. Here, the upper eccentric shaft 262 and the lower eccentric shaft 266 can be coupled to each other by fitting the lower eccentric shaft 266 into the upper eccentric shaft 262 so that the outer circumferential surface of the upper end portion of the lower eccentric shaft 266 can contact against the inner circumferential surface of the lower end portion of the upper eccentric shaft 262, and twist-fastening the eccentric shaft coupling nut 272 toward the upper eccentric shaft 262 from below the lower eccentric shaft 266. Also, it is preferable to rotate the eccentric shaft coupling nut 272 until the flange of the eccentric shaft coupling nut 272 strongly presses the stair part of the lower eccentric shaft 266.

Moreover, the lower end portion of the main shaft 200 can be easily inserted into the inner ring of the eccentric bearing 268, and can be easily separated from the eccentric bearing 268 by raising the main shaft 200 upward.

All of the small diameter portion 262*a* formed at the upper eccentric shaft 262, the small diameter portion 266*a* formed at the lower eccentric shaft 266, the upper bearing 281, the lower bearing 283, the upper bearing housing 282, and the lower bearing housing 284 are concentric, and the centerline of them coincides with the centerline of the main frame 10 and the upper frame 20. Moreover, the eccentric bearing 268, the cavity formed in the lower eccentric shaft 266 that accommodates the eccentric bearing 268, and the cavity formed inside the upper eccentric shaft 262 all have a centerline that coincides with the centerline 270 of the main shaft 200. The two centerlines deviate from each other by a small angle (refer to the lower end portion of the main shaft in FIG. 1). A point C at which the centerline of the main frame 10 or the like and the centerline of the main shaft 200 meet each other is located at the central point of a seal 258 of the rotary joint 250 located below the suspension bearing 222 (refer to FIG. 3).

On the other hand, a key groove 278 is formed at the lower end portion of the main shaft 200 accommodated inside the eccentric bearing 268, and similar to this, another key groove corresponding to the key groove 278 is formed in an inner ring of the eccentric bearing 268. A slip between the lower end portion of the main shaft 200 and the inner ring of the eccentric bearing 268 is prevented by inserting a key into the key grooves.

The lower portion of the main shaft 200 is formed in a tapered shape, and the central upper cavity of the upper eccentric shaft 262 through which the lower portion of the main shaft 200 pass has the same tapered shape but the diameter of the cavity is slightly greater than the diameter of the main shaft. Therefore, a gap in which lubricating oil can flow down along the main shaft 200 is formed between the main shaft 200 and the upper eccentric shaft 262. Lubricating oil is supplied to a lubricating oil jetting hole formed at the upper end portion of the upper bearing housing 282 through a conduit 282*a* provided inside the upper bearing housing 282 from the outer circuit (not shown). A plurality of the lubricating oil jetting holes may be formed. Also, the jetting angle of the lubricating oil jetting holes are set such that at least some of the lubricating oil jetting holes supply the lubricating oil toward the main shaft 200 and the remaining lubricating oil jetting holes supply the lubricating oil toward the upper bearing 281.

Since the upper bearing 281 and the upper eccentric shaft 262 rotate at high speed, the lubricating oil supplied to the upper bearing 281 is discharged from the lower end portion of the upper bearing 281 through a gap between a horizontal flat part of the upper eccentric shaft 262 and a lower end surface of the upper bearing housing 282 by centrifugal force, and the lubricating oil drops down on the upper surface of the lower bearing housing 284. Since the main shaft 200 rotates very slowly while performing high speed gyratory movement, the lubricating oil jetted to the main shaft 200 is slightly influenced by centrifugal force, and flows down along the main shaft 200 by gravity to lubricate the eccentric bearing 268. Although the inner ring of the eccentric bearing 268 rotates slowly with the main shaft 200, the rollers, the outer ring, the lower eccentric shaft 266 rotate at high speed, and the lubricating oil that has finished lubrication is discharged through the lubricating oil outlet 267 of the lower eccentric shaft by centrifugal force. Some of the lubricating oil that flows down from above and drops down on the upper surface of the lower bearing housing 284 is discharged to a lubricating oil outlet pipe 500 through the lower bearing 283, and some of the lubricating oil is directly discharged to the lubricating oil outlet pipe 500 from the upper surface of the lower bearing housing 284 and flows into a lubricating oil tank (not shown).

Also, two types of seals for preventing the lubricating oil from leaking, a labyrinth seal for preventing dust from entering to the two types of seals, and the like are provided at the lower eccentric shaft 266 and the lower bearing housing 284. However, since this is apparent to those skilled in the art, the detailed description is omitted.

In a previous cone crusher, the whole eccentric shaft is integrally formed. Therefore, a hole in the upper end portion of the eccentric shaft should be greater than the outer diameter of the eccentric bearing, and an upper bearing mount should be formed outside the hole so as to be eccentric from the hole in order to fit the eccentric bearing on the eccentric shaft. Therefore, the inner diameter of the upper bearing becomes much larger than the outer diameter of the eccentric bearing, and the size of the upper bearing of former cone crushers are at least one and half times greater than that of this invention. Thus, the cost of a cone-shaped crusher is increased. Also, since the rated rotating velocity of a large bearing is slow, the production capacity is reduced too. On the contrary, in the invention, the eccentric shaft is configured so as to be separable into an upper piece and a lower piece. Therefore, the size of the upper bearing 281 can be greatly reduced, and thereby, the costs of the cone-shaped crusher can be reduced, and the production capacity can be increased.

Figure 6:
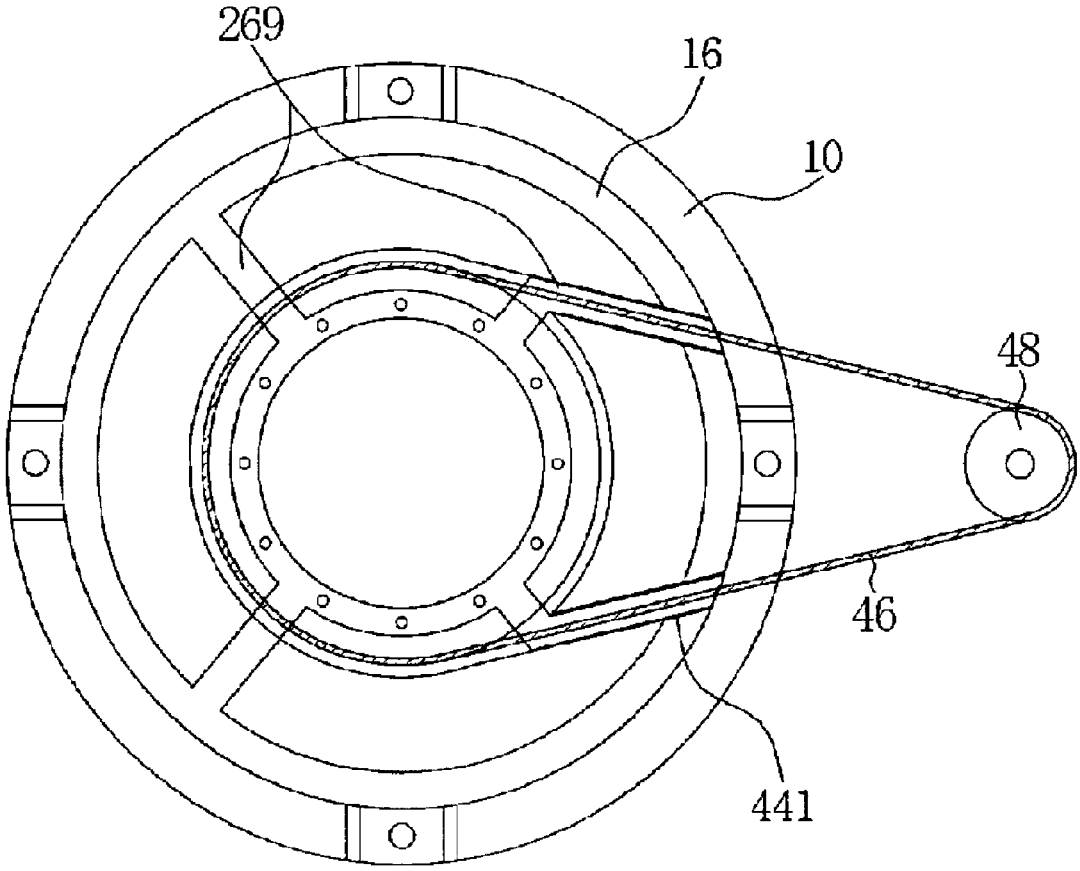
FIG. 6 is an excerpt bottom view of the cone-shaped crusher according to the invention.

FIG. 6 is an excerpt bottom view illustrating the cone-shaped crusher according to the invention.

Referring to FIG. 6, there are four link legs 269. Two legs among them have an arrangement angle and shape different from that of the other two legs. Among the legs 269, two legs, which gradually narrow toward the main frame outer wall 16, preferably have an angle and a shape such that a belt 46 connecting the pulley 44 of the crusher and the pulley 48 of a driving motor (not shown) can be protected. Also, in order to protect the belt 46 connecting the two pulleys 44 and 48, a belt protective lid 441 parallel to the two sides of the belt 46 exposed between both of the pulleys 44 and 48 may be provided. Referring to FIG. 1, the pulley 44 is mounted to a small-diameter end portion 266*a* of the lower eccentric shaft, and the pulley 44 is connected to and driven by a driving motor (not shown) via the belt 46. Since the two legs among the legs 269 which gradually narrow toward the main frame outer wall 16, the belt 46, and the belt protective lid 441 are provided on the same line, the shower of crushed objects does not strike the belt protective lid 441 and the belt 46 while passing between the link legs 269, and the crushed objects can be smoothly discharged from the lower portion of the main frame 10 without blocking.

Hereinafter, a dust seal of the invention will be described with reference to FIG. 1. According to other cone-shaped crushers, components constituting the dust seal 600 are provided in the mantle core assembly 300, and if the mantle core assembly 300 moves up and down, the components constituting the dust seal 600 also move up and down. As a result, if a mantle core assembly moves to a new position, the components are rapidly worn out until the spherical curvature of the components constituting the dust seal become equal to the geometric spherical curvature of the newly moved position, then the dust seal can be structurally stabilized. Moreover, this wear-out occurs whenever the mantle core assembly moves and the lifespan of the dust seal is short. However, the components constituting the dust seal 600 according to the invention are fixed at a certain height, do not move up and down, stay at the same position, and only perform a gyratory movement. Therefore, wear caused by a change in the spherical curvature does not occur, and a long lifespan is guaranteed.

Referring to FIG. 1, the dust seal 600 according to the invention includes a movable part 610 and a stationary part 620. The movable part 610 includes a lower lid plate 614 fixed to a lower flat surface of the piston 400 with bolts, a pipe-shaped mantle core guide part 618 extending vertically upward from an outer circumferential edge of the lower lid plate 614, a washer-shaped upper lid plate 612 provided outside the mantle core guide part 618, and a movable spherical plate 616 fastened to the upper lid plate 612 by bolts and having a spherical surface formed in the upper surface. The stationary part 620 includes a stationary spherical ring 624 having a large hole formed at its central portion and having a spherical surface formed at its lower surface, and a stationary spherical ring guide 622 having a flanged bottom surface tightly fixed to the upper surface of the upper bearing housing 282 and a short pipe-shaped vertical guide part perfectly fitting the inner hole of the stationary spherical ring 624. The stationary spherical ring 624 is capable of freely moving up and down along an outer surface of the stationary spherical ring guide 622, and the lower surface of the stationary spherical ring 624 always comes into close contact with the upper surface of the movable spherical plate 616 by gravity. Therefore, if the main shaft 200 performs a gyratory movement, the movable part 610 of the dust seal also performs a gyratory movement. However, the movable part 610 does not move up and down and always stay at the same vertical position. As described above, even if the mantle core assembly 300 moves up and down so as to adjust the crushing gap, the dust seal movable part 610 only performs a gyratory movement without any upward and downward movement. Moreover, an outer circumferential surface of the mantle core lower end portion 414 slides on an inner surface of the mantle core guide part 618. In the invention, in order to perfectly prevent dust from entering into the cone-shaped crusher, a method of inflating the stationary spherical ring guide 622 with compressed air is adopted. The compressed air blows out dust from every part that has a gap. For example, the contact surfaces of the movable spherical plate 616, the stationary spherical ring 624, the contact surfaces of the stationary spherical ring 624, the stationary spherical ring guide 622, the contact surfaces of an inner circumferential surface of the mantle core guide 618 and the outer circumferential surface of the mantle core lower end portion 414.

Now other embodiments of the invention are described.

Figure 4:
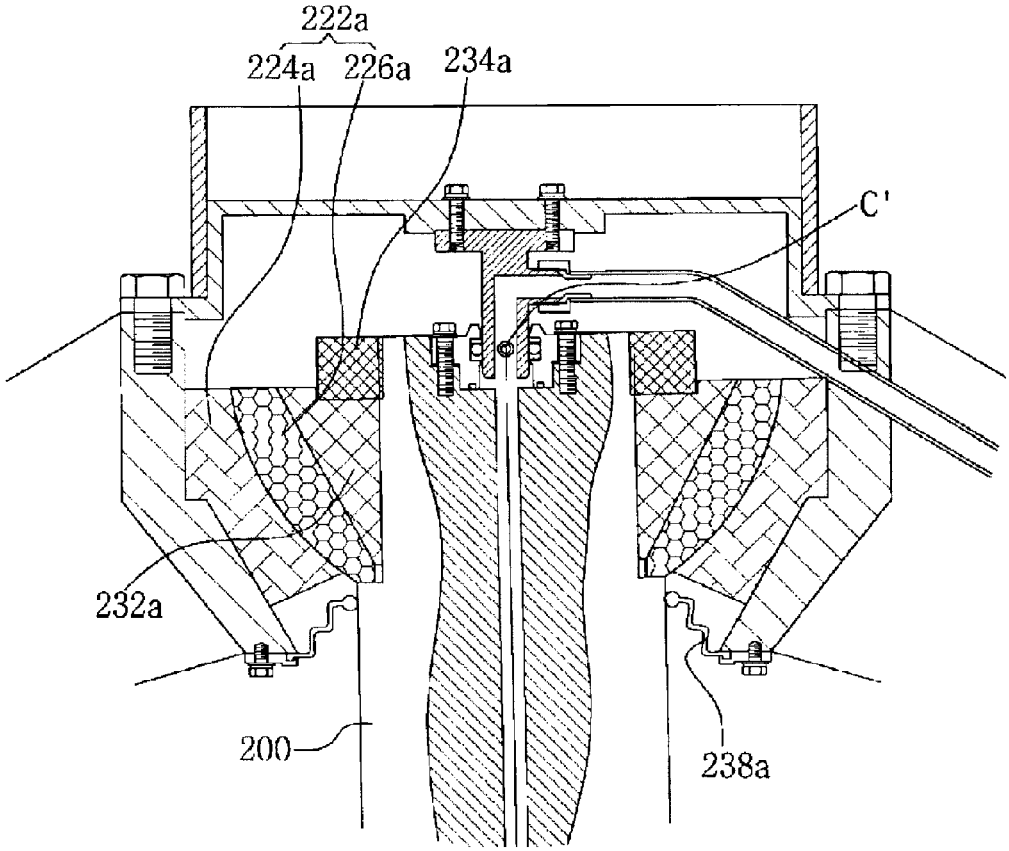
FIG. 4 is a partially enlarged view illustrating the upper end of the main shaft, and illustrating another embodiment to which a suspension bearing different from the suspension bearing shown in FIG. 3 is applied.

FIG. 4 is a partially enlarged view illustrating the upper end of the main shaft, and illustrating another embodiment to which a suspension bearing different from the suspension bearing shown in FIG. 3 is applied.

The spherical suspension bearing includes a female suspension bearing 224*a* and a male suspension bearing 226*a*. The male suspension bearing 226*a* is tightly fixed to the main shaft 200 with a fixing nut 234*a* by interposing a detachable sleeve 232*a* between the main shaft 200 and the male suspension bearing. In this case, the central point C' of a gyratory movement is moved upward so as to coincide with the central point of the spherical suspension bearing. Here, the central point C' is a point where the centerline of the main shaft 200 and the centerline of the main frame 10 meet each other. A seal 238*a* for preventing lubricating oil, such as grease which is supplied to the spherical suspension bearing, from leaking is formed of a material that is more elastic than the material of the seal shown in FIG. 1.

Figure 5:
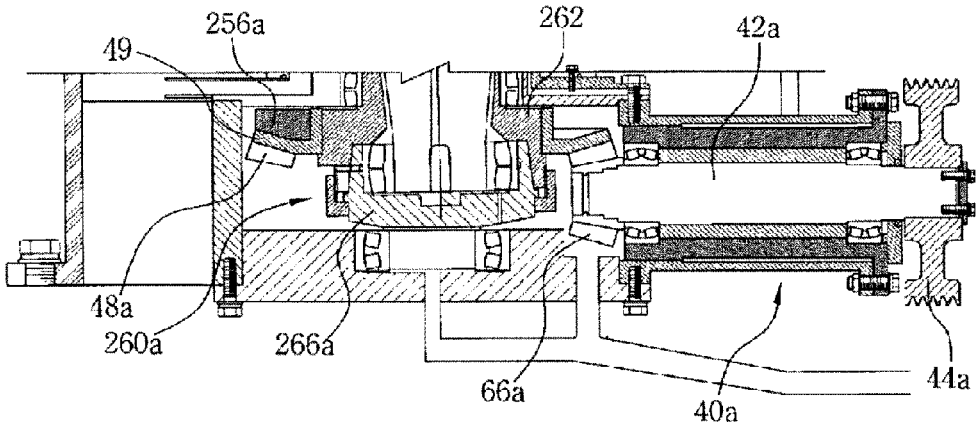
FIG. 5 is an enlarged view illustrating a lower end of the main shaft, and illustrating still another embodiment to which driving means for eccentric drive different from the driving means shown in FIG. 1 are applied.

FIG. 5 is an enlarged view illustrating the lower end of the main shaft, and illustrating still another embodiment to which driving means different from the driving means shown in FIG. 1 is applied so as to move the eccentric drive.

This embodiment illustrates that the power for the eccentric drive 260*a* making the main shaft 200 perform a gyratory movement is supplied by a pair of bevel gears. Such a gear driving type of power supply device is widely used in prior art cone-shaped crushers, and is well applied to the invention. A large bevel gear 48*a* is tightly fixed by inserting a fixing tool, such as a key, on a mount 49 formed on the upper eccentric shaft 262. A pinion gear 66*a* meshing with the bevel gear is tightly fixed to one end of a count shaft 42*a*, and a pulley 44*a* is fixed at the other end of the count shaft 42*a* and is supplied with power from a driving motor (not shown). A counterweight 256*a* is provided on the upper surface of the large bevel gear 48*a* so as to offset a vibration force generated by the eccentric arrangement of the mantle core assembly 300. The detailed description of other elements, such as a bearing and a bearing housing, which rotatably support the count shaft 42, will be omitted.

As described above, the invention has been described with reference to several embodiments.

Although the invention has been described by means of the limited embodiments and drawings, the invention is not limited by these, but those having ordinary knowledge of the art to which the invention belongs will apparently appreciate that various modifications and alternations are possible within the scope of the technical idea of the invention and the scope of the equivalents of the claims set forth below.

The invention claimed is:

1. A cone-shaped crusher comprising:

a frame having a cavity;

a main shaft disposed in the cavity eccentrically from the central axis of the frame; and an eccentric drive coupled to a lower end portion of the main shaft so as to make the main shaft undergo a gyratory movement, wherein the eccentric drive includes an upper eccentric shaft, a lower eccentric shaft, and an eccentric bearing, wherein the upper eccentric shaft has an opening provided at its central portion to allow the lower end portion of the main shaft to pass through the opening eccentrically from the rotation center of the upper eccentric shaft, and an upper coupling part provided at its lower portion and coupled to the lower eccentric shaft, wherein the lower eccentric shaft has a lower coupling part located below the upper eccentric shaft and fastened to the upper eccentric shaft, and wherein the eccentric bearing accommodates the lower end portion of the main shaft and is disposed in a space defined by the upper eccentric shaft and the lower eccentric shaft.

2. The cone-shaped crusher of claim 1, wherein the upper eccentric shaft has a small-diameter bearing mount for an upper bearing on its upper end portion.

3. The cone-shaped crusher of claim 1, wherein the lower eccentric shaft has an eccentric bearing mount formed inside an upper end portion of the lower eccentric shaft, the eccentric bearing being provided on the eccentric bearing mount; and a small-diameter bearing mount for a lower bearing on its lower end portion.

4. The cone-shaped crusher of claim 1, wherein a counterweight is provided at the upper eccentric shaft or the lower eccentric shaft so as to offset the vibration generated by the gyratory movement of the main shaft.

5. The cone-shaped crusher of claim 1, wherein in order to prevent slippage between the main shaft and the inner ring of the eccentric bearing, key grooves are formed in the lower end portion of the main shaft accommodated inside the eccentric bearing and the inner surface of the inner ring of the eccentric bearing, and a key is inserted into the key grooves.

6. The cone-shaped crusher of claim 1, wherein the opening formed in the upper eccentric shaft is processed in a taper shape such that the inner diameter of the opening gradually decreases downward from an uppermost end of the opening to a predetermined depth.

7. The cone-shaped crusher of claim 1 further comprising a plurality of lubricating oil jetting holes located above the upper eccentric shaft, wherein the discharging angle of the lubricating oil jetting holes is set such that some of the lubricating oil jetting holes supply the lubricating oil toward the main shaft and other lubricating oil jetting holes supply the lubricating oil toward an upper bearing fitted on the upper end portion of the upper eccentric shaft.

8. The cone-shaped crusher of claim 3, wherein the eccentric bearing mount has a diameter such that the eccentric bearing is mountable on the eccentric bearing mount, and the diameter is greater than the minimum diameter of the opening of the upper eccentric shaft.

9. The cone-shaped crusher of claim 3, wherein the lower eccentric shaft further includes a lubricating oil outlet that connects to the eccentric bearing mount and the outside of the lower eccentric shaft.

10. The cone-shaped crusher of claim 1, wherein an outer circumferential surface of an upper end portion of the lower eccentric shaft and an inner circumferential surface of a lower end portion of the upper eccentric shaft are tapered such that the diameter gradually decreases upward from below, wherein the lower eccentric shaft and the upper eccentric shaft are fastened to each other in a state where the lower eccentric shaft is fitted on the upper eccentric shaft such that the outer circumferential surface of the upper end portion of the lower eccentric shaft contacts against the inner circumferential surface of the lower end portion of the upper eccentric shaft.

11. The cone-shaped crusher of claim 10, wherein the eccentric drive further includes an eccentric shaft coupling nut, wherein the upper eccentric shaft includes a male thread formed in the outer circumferential surface of the lower end portion of the upper eccentric shaft, wherein a stair part is formed on a lower periphery of the lower coupling part of the lower eccentric shaft, wherein the eccentric shaft coupling nut has a flange capable of pressing the stair part of the lower eccentric shaft, and wherein a female thread coupled to the male thread of the upper eccentric shaft is formed on the inner circumferential surface of a pipe extending upward from the flange.

12. The cone-shaped crusher of claim 1, wherein the eccentric drive is driven by a first bevel gear mounted on the upper eccentric shaft or the lower eccentric shaft and a second bevel gear meshing with the first bevel gear.

13. The cone-shaped crusher of claim 1, wherein the eccentric drive is driven by a pulley directly mounted to the lower end portion of the lower eccentric shaft.

14. The cone-shaped crusher of claim 13, further comprising a belt protective lid provided parallel to two sides formed by exposed belts to protect the belts connecting the pulley.

15. The cone-shaped crusher of claim 14, further comprising an eccentric drive outer wall surrounding the outside of the upper eccentric shaft and the lower eccentric shaft, wherein the eccentric drive outer wall is fixed to the frame with a plurality of link legs, and wherein at least two of the link legs are parallel to the two sides formed by the belt.

* * * * *